United States Patent [19]

Bernard

[11] 4,294,577

[45] Oct. 13, 1981

[54] DYED FLOCKED FABRIC AND METHOD OF MAKING THE SAME

[75] Inventor: Leo N. Bernard, Plainfield, Conn.

[73] Assignee: Pervel Industries, Inc., Plainfield, Conn.

[21] Appl. No.: 133,864

[22] Filed: Mar. 25, 1980

[51] Int. Cl.[3] ..... D06P 5/00; D06P 7/00

[52] U.S. Cl. ..... 8/488; 8/494; 8/529; 8/531; 8/532; 8/534; 8/918; 8/922

[58] Field of Search ..... 8/488, 494, 529, 532, 8/531, 534, 918, 922

[56] References Cited

U.S. PATENT DOCUMENTS

| | | | |
|---|---|---|---|
| 3,236,586 | 2/1966 | Humphreys | 8/488 |
| 4,049,374 | 9/1977 | Rejto | 8/488 |
| 4,125,657 | 11/1978 | Gonzalez | 8/488 |
| 4,233,027 | 11/1980 | Albero | 8/488 |

FOREIGN PATENT DOCUMENTS

| | | | |
|---|---|---|---|
| 2199764 | 5/1974 | France | 8/488 |

*Primary Examiner*—A. Lionel Clingman

*Attorney, Agent, or Firm*—Hopgood, Calimafde, Kalil, Blaustein & Judlowe

[57] ABSTRACT

The invention contemplates a flocked fabric and method wherein flock is adhered by a heat-cured flock adhesive to a substrate fabric and wherein a heat-sublimable dye is contained as a component of the adhesive and/or as preprint of the substrate fabric, the adhesive having a curing time and temperature at which such dye substantially sublimes. Various examples are given to achieve different selectively available color patterns and contrasts, as well as different selectively available surface textures in the dyed product.

40 Claims, 7 Drawing Figures

DYED FLOCKED FABRIC AND METHOD OF MAKING THE SAME

BACKGROUND OF THE INVENTION

The invention relates to dyed flock-coated fabrics and to methods of making the same.

So far as I am aware, the dyeing of flock-coated fabric has to date involved one of several processes, each of which has its difficulties and limitations which impair product quality, or which involve undue product waste, or which do not lend themselves to as wide a variety of different ultimate finishes, textures and colors as might be desired.

According to one of these processes, the manufacturer of the flock-coated substrate fabric must tailor his production lot to what can be accommodated in a piece-dyeing operation, usually a service performed other than by the flock-coating house. The process involves scouring and rinsing the goods, bringing the goods to temperature in a dye bath, then introducing the dyes for a time and at a temperature appropriate to the class of dyes and goods involved. The dye bath temperatures are generally in the range 140 to 180 degrees Fahrenheit. This technique has disadvantages which include wastage of product at ends of the piece, great difficulty of making uniform color in the finished product, from one to the next piece, and the economies of continuous-run production are simply not available.

According to another process, a transfer-printing dye is applied to so-called greige goods, i.e., to undyed flock-coated substrate fabric. A dye-bearing transfer paper is faced against the greige goods in oriented lay-down of the flock, and oil-heated steel rolls apply contact heat and pressure by squeezing the paper to the fabric, the steel rolls being at at least 400° F., and the heat and pressure being applied for at least 30 seconds. Although the process is notas batch-limited as the piece-dyeing process, it is nevertheless relatively expensive due to paper waste and handling, and product texture and quality suffer from the application of heat and pressure to layed-down flock. The process is also inherently incapable of dyeing the substrate because the substrate materials are incapable of withstanding the greater temperatures and/or times needed to assure sufficient dye penetration via the flock.

BRIEF STATEMENT OF THE INVENTION

It is an object of the invention to provide an improved dyeing process having particular application to flock-coated fabrics.

A specific object is to provide a dyeing process for such fabrics wherein dyeing is achieved directly in the course of manufacture, thereby eliminating any need to manufacture a flock-coated fabric prior to dyeing.

Another specific object is to meet the above objects with a technique which lends itself to a very substantially increased variety of options for color development, color contrast, pattern development and finish-texture development, as compared to prior techniques.

It is a general object to achieve the foregoing objects at reduced cost, and with greater product quality than heretofore realizable in flock-coated fabrics.

The foregoing and other objects and features of the invention are achieved in a preferred embodiment by employing a heat-sublimable dye as a component of flock adhesive that is wet-coated to the substrate fabric as a preliminary to applying flock to the wet adhesive.

The flocked adhesive coat is dried at less than adhesive-curing temperature, and the dried coated fabric is then subjected to a curing time and temperature which enables (a) color development by sublimation and (b) adhesive curing. The techniques may be embodied in the otherwise-conventional continuous-run production process of the flock-coating house. The technique lends itself to a variety of color-contrast, pattern-contrast and surface-texturing effects for which illustrative examples are given.

DETAILED DESCRIPTION

Figure 1:
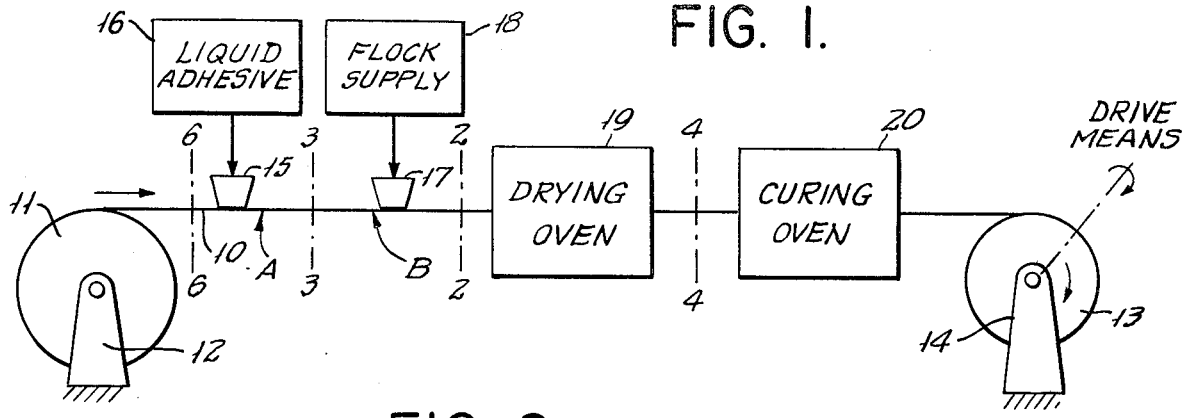

The invention will be described in detail in conjunction with the accompanying drawings, in which:

FIG. 1 is a diagram which schematically depicts successive steps in the method of the invention, for producing dyed flock-coated fabrics; and FIGS. 2 to 7 are fragmentary diagrams, applicable to various of the locations 2—2, 3—3, 4—4 and 6—6 in FIG. 1, to illustrate optional operative steps for producing different appearance and texture variations in the product of the method.

Referring to FIG. 1, the method of the invention illustratively utilizes flock-coating equipment comprising means for processing a continuous length of substrate fabric 10, from a supply roll 11 on a suitable stand 12 at one end, to a driven take-up roll 13 for finished product on a suitable stand 14 at the other end. The substrate fabric 10 is shown first to pass an applicator station A, where a coating applicator 15 extends the full coating width of the web of fabric 10 and is continuously supplied with a suitably regulated flow of liquid flock adhesive from a supply means 16. In similar fashion, at a downstream-offset flocking station B, a flock applicator 17 extends the full adhesive-coated width of the fabric 10 and is continuously supplied with a suitably regulated flow of flock material from a supply means 18. After flock application to the wet adhesive coat, the continuous-production equipment is shown to include a first oven 19 or ovens set to dry the adhesive but not to cure the same. Thereafter, the flocked fabric with dried adhesive is subjected to conditions of curing temperature and time as it passes through a curing oven 20. After curing at 20, the finished product is wound upon take-up roll 13, for storage or shipment, as required.

The means 15 of adhesive coating and the means 17 of flock application and orientation, including their respective supply means 16–18 are existing, well-known devices, and need no further description for present purposes; also, the ovens 19–20 including festoons therein (not shown) and various drive and support rolls (not shown) along the length of web under treatment are well-understood and require no present description.

In accordance with one mode of the invention, a heat-sublimable dye is an essential additive component of the liquid adhesive supply at 16. The quantity of such adhesive mixture may be sufficient for an entire run, or it may be adquate to serve only a fraction of an entire continuous run, it being in the latter case necessary for an operator to monitor the current supply level at 16 and to replenish with fresh mixture as needed. The proportions of dye material and adhesive components may be so readily maintained to sufficiently close tolerances that color in the resulting product is not degraded by the fact that a given run uses batch-mixed replenishment of the dye-compounded liquid adhesive.

At the drying oven or ovens 19—19', the wet flocked fabric web is exposed for a time and at temperature (e.g., 200° F.) to achieve adhesive drying without curing. Then in the curing oven 20, the web passes through successive zones (e.g., three) of progressively greater temperature. Illustratively, curing at 20 may proceed at temperatures of 275° F. in a first oven zone, 350° F. in a second oven zone, and 400° F. in the third oven zone. A total time of 12 to 14 minutes is shared in roughly equal fractions at the respective curing-oven zones, and it has been found with materials thus-far employed that a final curing time of four minutes at 400° F. is desirable, for best heat-development of the sublimable dye components used, as well as for curing of the adhesive. Stated in other words, a greater length of time at 400° F. curing temperature has not thus far established any improvement in dye-color development, but a different oven, such as multiple-pass curing oven would probably permit a shorter overall curing time at 400° F., for both the adhesive and its dye component.

In another mode of the invention, the greige substrate fabric is gravure or otherwise printed with heat-sublimable dye prior to the adhesive-coating step. The coating-adhesive may be colorless or it may contain a heat-sublimable dye selected for ultimate color contrast with that which had been printed on the substrate fabric. Flock application, drying and curing then proceed as before, to produce a finished product, would upon the take-up roll 13.

Examples of different product, made by variously combined steps of the indicated methods will be specifically described.

EXAMPLE I

Starting with a woven cotton substrate, a wet layer of flock adhesive was applied before flocking with natural 3-Denier Trilobal* nylon, cut to 80-mils length. The substrate was 100 percent cotton, being unnapped, soft-filled sheeting. Adhesive was applied at approximately 3 ounces/square yard, and flock was also applied at approximately 3 ounces/square yard. The adhesive was a commercially available acrylic water-based flocking adhesive, in which a 3 percent addition of heat-sublimable dye had been mixed. The dye materials were those intended for heat-transfer inks and were products of Verona Dyestuff Division of Mobay Chemical Corporation, Union, New Jersey, being their dyes known as Resiren yellow T-4G-WN Liquid and Resiren blue TGL-WN Liquid, in the proportions:

1 percent Resiren yellow T-4G-WN Liquid
2 percent Resiren blue TGL-WN Liquid Upon drying the flocked adhesive-coated substrate, the treated surface was light gray in color (being the color of the uncured adhesive), but after curing in the manner indicated, i.e., concluding with four minutes at 400° F., the dye had been developed by sublimation to a uniform relatively dark green at the adhesive-coat, being visible over the entire flocked surface as what I would call an apple green, modulated only by bright flock highlights of lighter green, as a function of light-incidence upon the flocked fabric. It is my belief that, except for the above-noted highlighting effect, the relatively dark overall appearance of the fabric is in important degree attributable to the somewhat fiber-optic nature of the individual pieces of flock, in relatively uniform stand-up adjacent array, and of course it is possible that to the degree that dye had bled into the flock, the strength of the coloring is enhanced. The finished fabric has a soft uniform velvet-like feel or hand and is highly resistive to fading.

*A trademark of the DuPont Company

EXAMPLE II

Starting with a knitted polyester substrate, the same procedures were followed as with Example I, the only difference being as to the selection of heat-sublimable dye mixed in the adhesive. The selected dye proportions in the adhesive were:

1 percent Resiren yellow T-4G-WN
2 percent Resiren red TFB-WN Liquid

Results of drying and curing in the manner of Example I produced a uniform soft rust color in the flocked side of the fabric, with a hand and fastness as for Example I.

EXAMPLE III

Figure 2:
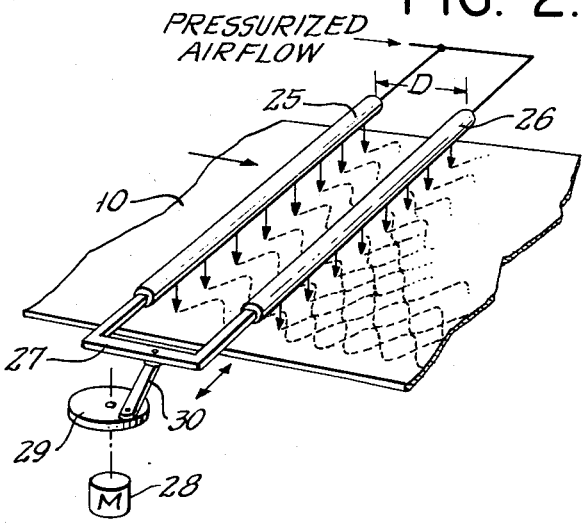
Figure 3:
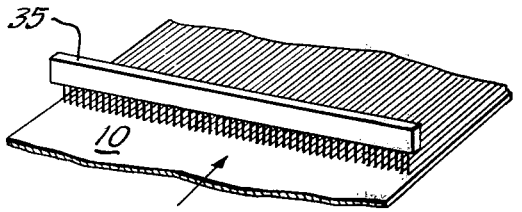

Starting with the cotton sheeting, adhesive-coating, and dye-content of Example I, the flocked coated substrate fabric was subjected to precisely the same drying and curing procedures as in Example I, except that at location 2-2 of FIG. 1, i.e., between the location of flock-application and entry to drying oven 19, the flocked and still-wet adhesive-coated side of the fabric was subjected to an air-embossing step, for which operative mechanism is schematically shown in FIG. 2.

The mechanism of FIG. 2 comprises two elongate manifolds 25-26 in the form of tubular pipes drilled and fitted at spaced locations to define downwardly directed air jets, symbolized by downward arrows at spaced locations. The manifolds 25-26 are supplied at one end by a suitable source of pressurized airflow, and they are closed at their other end. Manifolds 25-26 are held in fixed parallel relation, at longitudinal spacing D, above the coated and flocked surface of web 10 and are oriented transverse to the direction of web movement. The means for holding manifolds 25-26 at their spacing D includes (a) a yoke 27 at their closed ends and (b) guide means (not shown) whereby oscillatory displacement may be imparted to manifolds 25-26 in the direction transverse to the direction of web movement, a motor 28 being shown with crank 29 and link 30 connection to yoke 27 for imparting such motion.

In the air-embossing use of the device of FIG. 2 in Example III, the air jets along each manifold 25-26 were at 1.5-inch spacing, the amplitude of transverse oscillation imparted by means 28-29-30 was 2.25 inches, and the distance D was so selected in relation to the speed of web displacement and to the oscillation cycle that sinusoidal air-embossments on the web 10 due to jet action from the upstream manifold 25 were at 180 degrees phase-offset from the corresponding sinusoidal air-embossments on the web due to jet action from the downstream manifold. The full cycle of transverse oscillation repeated at 8-inch intervals in the direction of web movement.

The finished product was green as in Example I, except that surface texture had been characterized by a permanent pattern of entwined 180°-displaced sinusoids, wherein each sinusoid due to manifold 25 lapped the adjacent three 180°-displaced sinusoids of manifold 26, and vice verse. The air blasts from manifolds 25-26 locally incline affected flock, and curing retains the inclination. The result is not only a highlighted appearance effect, in accordance with the entwined-sinusoid pattern, but also a textured feel akin to velvet which has had similarly textured shearing.

EXAMPLE IV

Starting with a woven polyester-cotton osnaburg fabric, the side to be flocked was first screen-printed with a non-adhesive print paste wherein the dye ingredient was again of the heat-sublimable variety, the print dye being of a heat-developable first color A, and the thus-printed surface of the web 10 was then adhesive-coated with adhesive containing a second dye of heat-developable color B. Flocking,drying and curing were otherwise as described for Example I.

The non-adhesive print paste was a water-diluted mixture comprising a 4-percent addition of Resiren blue TGL-WN Liquid in a stock solution of carrier in water, the latter being a 4 percent solution of stock print thickener (specifically, Chemloid Auxiliary 0155M) in water. And the printed surface of the web was dried before application of the flock adhesive. The dye selected for mixing in the adhesive was Resiren red TFB-WN Liquid, added as a 2 percent component of the liquid adhesive.

As indicated, flocking, drying and curing steps proceeded as in Example I, but the curing step was operative upon the heat-sublimable dye components of both the print paste and the adhesive. The resulting product had the texture and feel of the product of Example I, but the color appearance was in accordance with the striped print pattern, wherein soft purple alternates with soft red. The stripes had been printed ⅛-inch wide, at ⅛-inch spacing, and so at moderate viewing distance from the product, e.g., five or more feet away, the appearance was that of a soft red-modulated magenta. The hand and fastness of the product were as described for Example I.

EXAMPLE V

Using a 284 polyester-cotton osnaburg substrate and applying the adhesive mix of Example I (i.e., with the potential for heat-development to green), a fixedly mounted gouging comb 35 (FIG. 3) was applied to the surface of the adhesive, just prior to flocking with natural flock; this location is designated 3-3 in FIG. 1. The flock was also as described for Example I except that it was a random-cut nylon, of 40 mils maximum length. The gouging comb had teeth at ⅛-inch spacing, across the adhesive-coated width of the substrate, thereby producing parallel elongate ribs and valleys to which the flock was applied. Upon drying and curing as described for Example I, the product was green and had the appearance and feel of a corduroy, combined with the feel of a short-cropped velvet. Ribs are highlighted, and valleys are darker.

EXAMPLE VI

Figure 4:
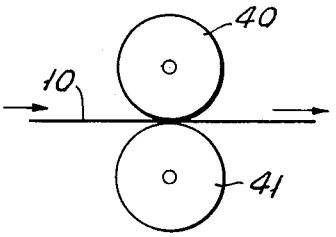
Figure 5:
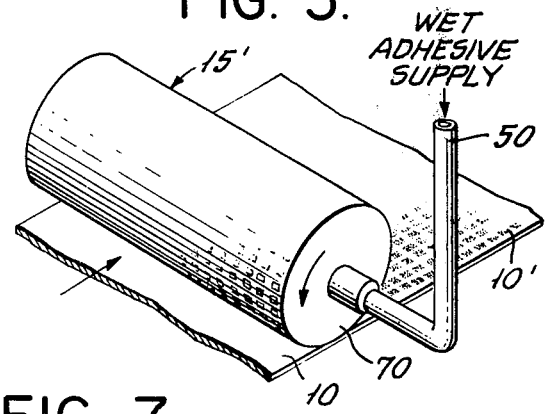
Figure 6:
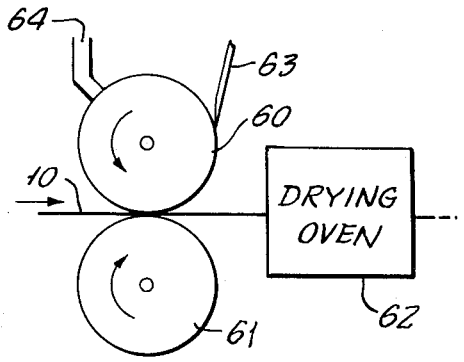
Figure 7:
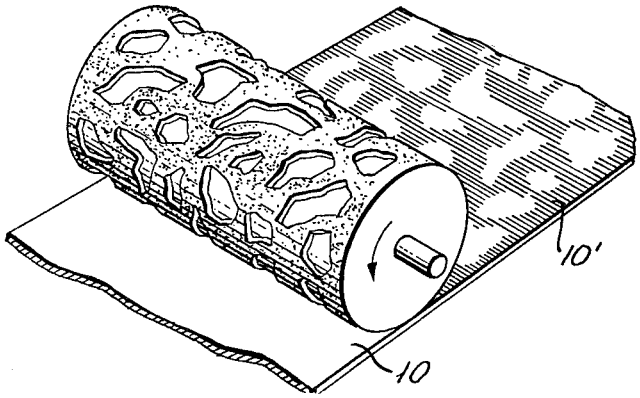

Adopting the substrate, adhesive mix and short flock material of Example V, the gouging step was omitted, and therefore the flock was applied to the smooth surface of the wet adhesive coat. The wet adhesive of the flocked substrate was then dried in oven 19; but at location 4-4 (FIG. 1), the flocked surface of the substrate was subjected to embossing pressures by passage between an embossing roll 40 and its associated backing-pressure roll 41 (FIG. 4). The embossing pattern had been engraved in the cylindrical surface of roll 40, in the form of intersecting finite longitudinal and transverse lines, the engraving being to 30-mil depth, i.e., to a depth exceeding the cut length of the flock. The rolls 40-41 were heated to 400° F. so that primary initial heat transfer to the dye components of the adhesive could be at valley regions of the flocked goods. Adhesive curing required less than the four minutes desired for full color development, and the exposure at curing oven 20 was limited to the one minute (at 400° F.) required for adhesive curing. The finished goods had cleanly and clearly defined embossment faithful to the engraving pattern, with background valley regions of darker blue-green and with lighter, almost gray, blue green at the ribs of the embossment, reflecting in the embossment regions less than the more complete color development which was accomplished in the background or valley regions. The product lends itself admirably to richly textured wall-covering application.

EXAMPLE VII

Starting with the woven-cotton substrate of Example I, but dyed to a light-blue color, a flock adhesive was applied through a stencil pattern which characterized the cylindrical surface of an adhesive-application rotary screen or roll 15' (FIG. 5), in place of the means 15 of FIG. 1. Surface motion of roll 15' at contact with the substrate web 10 matched that of web 10, and a regulated flow of adhesive was supplied to roll 15' via suitable non-rotating end-fitting means 50. The adhesive had as an essential component a 3 percent addition of Resiren blue TGL-WN Liquid. The flock was again the 80-mil cut Trilobal natural nylon of Example I, but of course it adhered to the adhesive-coated substrate only in accordance with the stencil pattern of adhesive coating. Upon drying and curing, with full four-minute exposure at 400° F., the finished product was an overall dark blue, characterized by fine light-blue where substrate was exposed between the larger tufts of dark-blue velvet which dominated the appearance.

CONCLUSION

It will be seen that the described invention meets all stated objects and introduces a new dimension to the variety of fabric colors, patterns and textures which the flock-coating house may provide to its customers. Not only is the variety of product increased, but this is done at great economy as compared to prior techniques which required batch handling, dye-transfer paper, piece-dyeing and other operations which are no longer necessary. In other words, the desired end result of a finished product is achieved without the need for any after-finishing, liquid or mechanical. Moreover, uniformly superior quality of the end product is much more readily controlled and assured, without introducing any undesired surface distortions (coloring or texture) in the finished product. The process of the invention provides tremendous saving by avoiding or substantially reducing the need for large inventories of raw materials or in-process goods, in that one or a few possible substrates and merely natural flock can well serve for the production of a wide variety of differently dyed products, the only needed change-over being in the cleaning and mixing of correct heat-sublimable dye additive to the wet adhesive mixture. Further savings are realized in raw material (water, scouring agents, softeners and chemicals) and in energy and labor, through the one-pass technique of the invention, as compared to conventional dyeing procedures, including pre-dyeing of substrate and/or flock, and the pigmenting of adhesives in conventional colored flocking.

In the case of Example IV, it should be noted that a velvety stand-up look was uniform over the entire flocked surface of the product, and this represents a product that, to my knowledge, is also new. In the past, print-transfer printing techniques applied to flocked fabric have required (a) steam-aging to develop color, and (b) washing; the resulting products is characterized by wring marks, "rope" marks and the like, all without assurance of a uniform velvety stand-up of the flock. It is also to be noted that in any print-transfer of dye to flocked fabric, the dyed region is only skin deep, for example, there is not enough dye penetration into the substrate to permit use of the flocked fabric along as a drape, a lining being required for thus-printed fabrics. On the other hand, with dye as an integral part of the full adhesive coat, an opacity is achieved which enables drape functions to be well served, in solid color or patterned colors, without requiring a lining.

While the invention has been described in detail for preferred method steps and structures, it will be understood that the specific disclosures and examples given are merely illustrative and are not limiting, in that modifications may be made without departing from the scope of the invention. For example, instead of pre-printing the substrate, as described in Example IV, the pre-printing step may be incorporated in continuous-run production of the ultimate fabrics, such pre-printing being for example through use of gravure-printing rolls 60-61 and subsequent oven-drying at 62 (FIG. 6), applied at location 6-6 of FIG. 1, i.e., prior to adhesive coating; in FIG. 6, a doctor blade 63 assures a uniformly clean gravure-roll surface for continuous fresh application of printing paste at 64, the paste being as described in Example IV, namely including one or more heat-sublimable dyes as an essential component.

Also, while embossing may be of the high-pressure steel-die delineated variety described for Example VI, it will be understood that other embossing techniques may be employed. A "soft" embossing technique may for example employ a patterned relief in the cylindrical surface of a large-diameter soft roll 70 of foamed polyurethane which is either driven to match the surface speed of wet-adhesive coat or is alloed to lightly drag its contact with the adhesive coat of passing web 10. Such a step would occur just after flocking, e.g., at 2-2 in FIG. 1, wherein the "soft" embossing is seen at 10' to have been the cause of locally "laying down" the flock, or at least modulating its otherwise stand-up orientation.

Still further, although the recited specific examples have involved use of woven cotton fabric and woven polyester fabric, the invention is clearly not so limited, in that the fabric may be knitted or non-woven, and the fiber or blend may be selected from the wide variety of those available as long as it can withstand the temperature exposures indicated for curing of flock adhesive and heat-sublimable dye. Thus, the fabric may be selected from polyester, nylon, acrylic, polyrayon and acetate varieties; the fabric may also be a blend of one or more of such fibers with or without cotton; and the flock need not be Trilobal but, rather, for example, may be a selected one of the nylon, acrylic and polyester varieties available. Still further, the flock adhesive may be solvent-based and therefore not necessarily the water-based adhesive mentioned in the present specific examples.

What is claimed is:

1. The method of producing a dyed flocked fabric, which comprises selecting a suitable substrate fabric, coating the substrate fabric with a wet layer of flock adhesive, said adhesive having as an essential component thereof a selected heat-sublimable dye, selecting flock of a material capable of being dyed with a heat-sublimable dye, applying the selected flock to the wet coating of flock adhesive, drying the adhesive at a temperature less than that at which said dye sublimes, and then curing the adhesive by exposing the dried flocked substrate for a predetermined period of time to an elevated curing temperature at which said dye substantially fully sublimes.

2. The method of claim 1, in which said substrate is a woven fabric.

3. The method of claim 1, in which said substrate is a knitted fabric.

4. The method of claim 1, in which said fabric is of a material selected from the group comprising cotton, polyester, nylon, acrylic, polyrayon, and acetate.

5. The method of claim 1, in which said substrate is a cotton fabric.

6. The method of claim 1, in which said substrate is a polyester fabric.

7. The method of claim 1, in which said substrate is a fabric of blended cotton and polyester.

8. The method of claim 1, in which said fabric is of a blended material comprising two or more materials selected from the group comprising cotton, polyester, nylon, acrylic, polyrayon and acetate.

9. The method of claim 1, in which said flock is of a material selected from the group comprising nylon, acrylic, and polyester.

10. The method of claim 1, in which an air-embossing step is performed after the flock-application step and prior to the drying step.

11. The method of claim 1, as a continuous process, wherein the substrate fabric is an elongate continuously transported web, and continuously winding as a completed product the thus-cured flock-coated substrate web.

12. The method of claim 11, in which an additional step of gouging the wet-adhesive coating is performed prior to the drying step.

13. The method of claim 12, wherein the gouging is at equally spaced locations transverse to the direction of web transport.

14. The method of claim 11, in which a roll-embossing step is performed on the wet-flocked coating prior to the drying step.

15. The method of claim 14, in which the embossing roll is relatively soft and yielding.

16. The method of claim 11, in which a roll-embossing step is performed on the flocked coating after the drying step and prior to the curing step, the embossing roll being relatively hard and non-yielding.

17. The method of claim 11, in which the curing step includes continuously tensed application of the uncoated side of the substrate web to a roll heated at least to curing temperature.

18. The method of claim 17, in which the heated roll is pattern-embossed, whereby heat-transfer to the dried web and therefore dye-sublimation are locally enhanced for color contrast in accordance with the embossment pattern.

19. The method of claim 16, in which the engraved depth of the embossing roll is less than the flock length.

20. The method of claim 16, in which the engraved depth of the embossing roll is greater than the flock length.

21. The method of producing a dyed flocked fabric, which comprises selecting a substrate fabric having the ability to withstand approximately a four-minute exposure at substantially 400 degrees Fahrenheit ambient temperature, which comprises coating the substrate fabric with a wet layer of flock adhesive, said adhesive having as an essential component thereof a heat-sublimable dye, selecting flock of a material capable of being dyed with a heat-sublimable dye, applying the selected flock to the wet coating of flock adhesive, drying the adhesive at a temperature so sufficiently below 400 degrees Fahrenheit as not to cure the adhesive, and then curing the adhesive at substantially 400 degrees Fahrenheit for a period of approximately four minutes.

22. The method of claim 21, in which the component proportion of dye in the flock adhesive is in the range up to substantially five percent.

23. The method of claim 22, in which said range is substantially one to substantially four percent.

24. The method of claim 21, in which the adhesive is of a water-based acrylic.

25. The method of claim 21, in which the dye component added to the flock adhesive is a water-based mixture of a selected one or more pure dyes.

26. The method of claim 1, in which the adhesive is uniformly applied.

27. The method of claim 1, in which the adhesive is applied in a pattern of localized application.

28. The method of claim 21, in which the substrate fabric is dyed prior to adhesive application.

29. The method of producing a dyed flocked fabric, which comprises selecting a substrate fabric, printing the substrate fabric with a selected heat-sublimable dye, coating the printed substrate fabric with a wet layer of flock adhesive, selecting flock of a material capable of being dyed with a heat-sublimable dye, applying the selected flock to the wet coating of flock adhesive, drying the adhesive at a temperature substantially less than that at which said dye sublimes, and then curing the adhesive by exposing the dried flocked and printed substrate for a predetermined period of time to an elevated curing temperature at which said dye substantially fully sublimes.

30. The method of claim 29, in which said adhesive is clear.

31. The method of claim 29, in which said adhesive has as an essential component thereof a selected second heat-sublimable dye.

32. The method of claim 31, in which the printing step comprises a patterned printing with said first-mentioned dye, said second dye being of different developable color than said first dye, whereby upon sublimation, said second dye has color contrast with respect to patterned printed areas of the fabric.

33. The method of claim 29, in which the selected substrate fabric is a dyed fabric.

34. The method of claim 29, in which the selected substrate fabric is a fabric of natural fibers.

35. The fabric product of the method of claim 1.

36. The fabric product of the method of claim 21.

37. The fabric product of the method of claim 29.

38. A dyed flocked fabric, comprising a substrate fabric, a cured flock adhesive coating on one side of said fabric, and flock adhered to said substrate fabric via said cured adhesive coating, said flock being of a material capable of being dyed with a heat-sublimable dye, and said adhesive coating including as an essential component thereof a substantially sublimed heat-sublimable dye.

39. A dyed flocked fabric, comprising a substrate fabric printed with a heat-sublimable dye, a cured flock adhesive coating on one side of said fabric, and flock adhered to said substrate fabric via said cured adhesive coating, said flock being of a material capable of being dyed with a heat-sublimable dye, and said adhesive coating having a curing temperature and curing time at which said dye substantially sublimes.

40. The dyed flocked fabric of claim 39, in which said adhesive coating includes as an essential component thereof a second heat-sublimable dye which substantially sublimes in the circumstance of said temperature and time.

* * * * *